United States Patent [19]

Baughn et al.

[11] 4,204,663

[45] May 27, 1980

[54] APPARATUS FOR LIFTING A REEL

[75] Inventor: William E. Baughn, Bessemer, Ala.; Kenneth R. Williams, Alabaster; M. Khristian McAlister, Mountain Brook, all of Ala.

[73] Assignee: Milton J. Baughn, Bessemer

[21] Appl. No.: 26,081

[22] Filed: Apr. 2, 1979

[51] Int. Cl.[2] ..... E02C 3/00

[52] U.S. Cl. ..... 254/88; 254/134.3 R; 242/58.6

[58] Field of Search ..... 254/88, 100, 134.3 R; 242/58.6, 64, 79; 144/3 K; 414/911, 538, 559, 276

[56] References Cited

U.S. PATENT DOCUMENTS

| | | | |
|---|---|---|---|
| 1,001,272 | 8/1911 | Howard | 144/3 K |
| 1,254,794 | 1/1918 | George | 254/88 |
| 1,271,584 | 7/1918 | Klemme | 254/88 |
| 2,622,816 | 12/1952 | Koch | 242/58.6 |
| 3,298,667 | 1/1967 | Grantham et al. | 254/100 |

*Primary Examiner*—Robert C. Watson

*Attorney, Agent, or Firm*—Woodford R. Thompson, Jr.

[57] ABSTRACT

Apparatus for lifting a reel from a supporting surface with the reel having centrally disposed axles projecting laterally from opposite sides. Upwardly inclined guide rails are supported in spaced, parallel relation with the upper surfaces of lower portions thereof engaging the under surfaces of the axles while the reel is supported on the supporting surface. A flexible member is connected to each axle and extends toward the upper portion of the adjacent guide rail. Drive means is connected to and pulls the flexible members and the axles connected thereto upwardly along the guide rails toward upper portions thereof to lift and support the reel above the supporting surface.

5 Claims, 5 Drawing Figures

FIG. 3
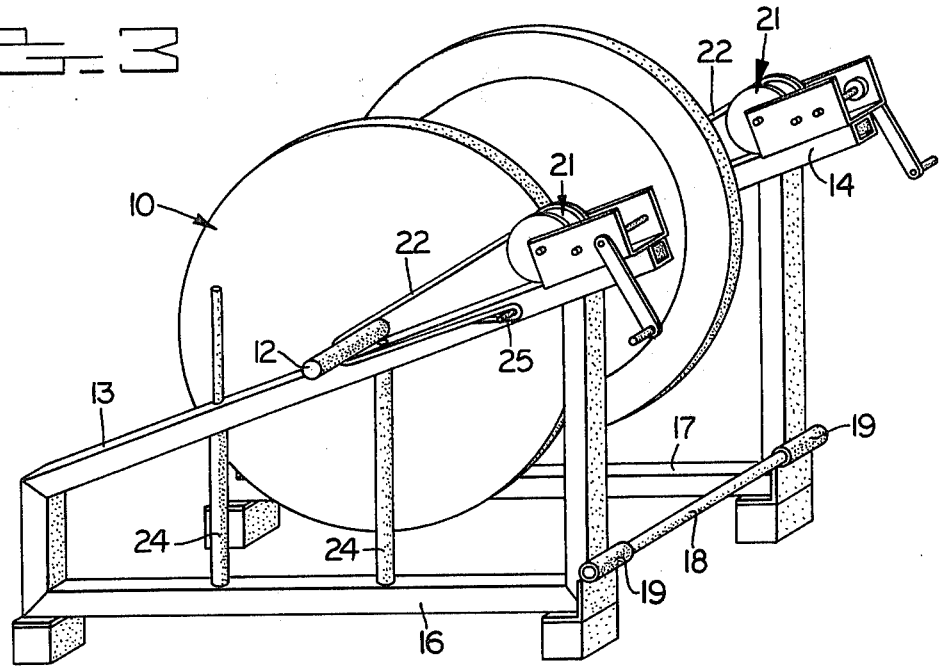
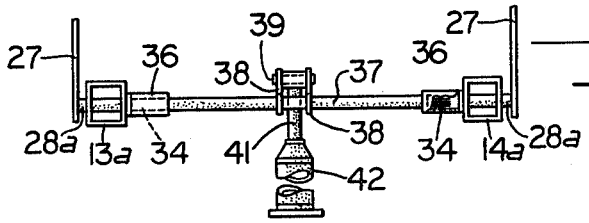
FIG. 5
FIG. 4
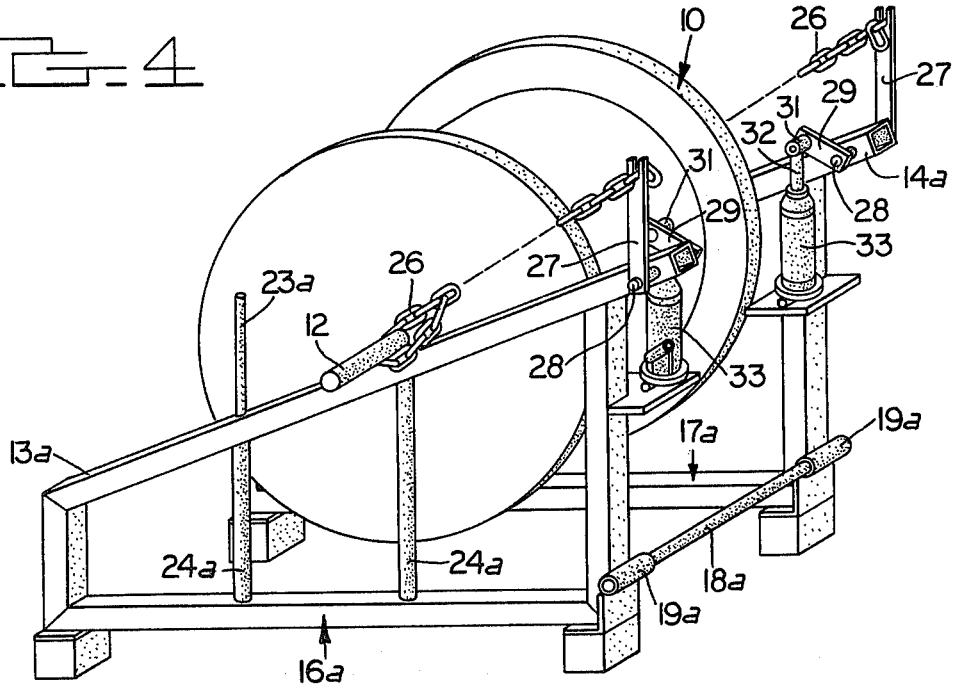

APPARATUS FOR LIFTING A REEL

BACKGROUND OF THE INVENTION

This invention relates to apparatus for lifting a reel-like member from a supporting surface with the reel-like member having centrally disposed axle members projecting laterally from opposite sides thereof. The apparatus is particularly adapted for lifting heavy reels of wire, cable, belting and the like whereby the wire, cable or belting may be dispensed while the reel is supported at an elevation above the supporting surface.

As is well known in the art to which my invention relates, difficulties have been encountered in handling heavy reels of wire, cable, belting and the like due to the fact that no effective means has been provided for supporting such reels for rotation at an elevation above the supporting surface whereby the material on the reel may be dispensed by pulling the free end of the material to impart rotation to the reel as the material is dispersed. Also, difficulties have been encountered in providing apparatus for handling large, heavy reels having different diameters and widths.

SUMMARY OF THE INVENTION

In accordance with my invention, I overcome the above and other difficulties by providing upwardly inclined guide rails which are supported in spaced parallel relation to each other with the upper surface of lower portions thereof being positioned to engage the under surface of laterally projecting reel axles while the reel is supported on a supporting surface. The reel axles are operatively connected to flexible members which extend toward the upper portion of the guide rails and drive means is operatively connected to the flexible members so as to pull the flexible members and the axle members connected thereto toward the upper portions of the guide rails whereby the axle members are moved upwardly along and supported by the guide rails as the reel is lifted above its supporting surface.

An object of my invention is to provide apparatus for lifting a reel of the character designated which shall be simple of construction, economical of manufacture and one which may be readily assembled and disassembled with a minimum of effort. A further object of my invention is to provide apparatus for lifting heavy reel-like members which may be easily operated by one person and at the same time provide maximum safety to the person handling the heavy reel. A still further object of my invention is to provide apparatus for lifting a reel of the character designated which will handle reels of various diameters and widths.

DESCRIPTION OF THE DRAWINGS

Apparatus embodying features of my invention is illustrated in the accompanying drawings, forming a part of this application, in which:

FIG. 3. is an isometric view showing a reel as it is pulled up the inclined guide rail toward the uppermost position on the apparatus;

FIG. 4 is an isometric view showing a modified form of my invention; and,

FIG. 5 is a fragmentary view, partly broken away and in section, showing a further modified form of my invention.

DETAILED DESCRIPTION

Figure 1:
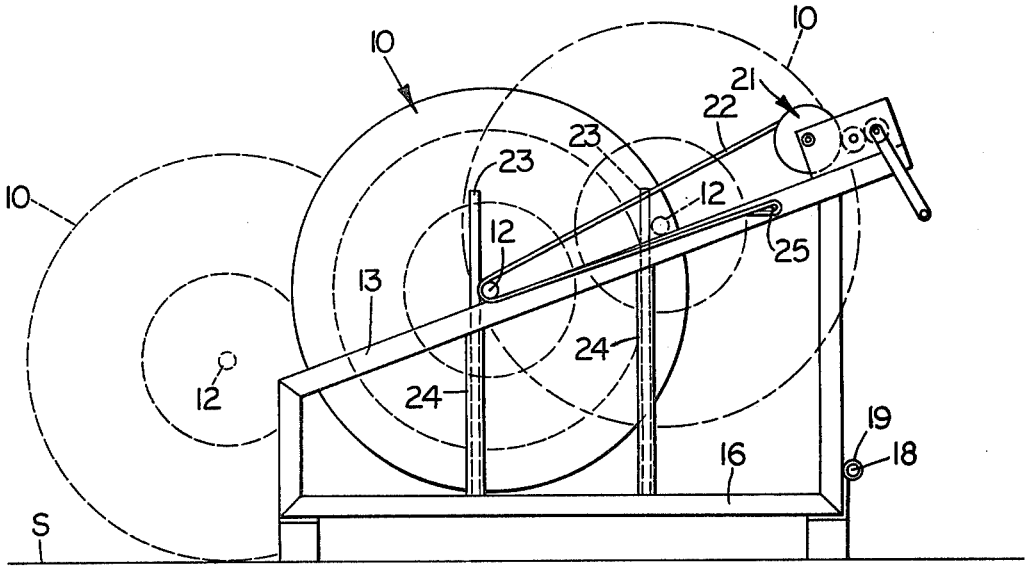
FIG. 1 is a side elevational view showing a reel supported on a supporting surface in dotted lines, supported at a lower position on the apparatus in solid lines, and supported at an upper location on the apparatus in dot-dash lines.

Referring now to the drawings for a better understanding of my invention, I show a conventional type heavy reel 10 having wire cable 11 wound thereon. The reel 10 may be supported by a centrally disposed shaft or axle which may pass through a centrally disposed opening provided in the reel so as to provide centrally disposed axle members 12 which project laterally from opposite sides of the reel 19, as shown in FIG. 2.

My improved apparatus for lifting a reel comprises upwardly inclined guide rails 13 and 14 which are supported in spaced parallel relation to each other with the upper surfaces of lower portions of the rails 13 and 14 being in position to engage the under surface of the axle members 12 while the reel is supported by the supporting surface indicated at S. That is, with the reel 10 being supported on the supporting surface S, each axle member 12 is at an elevation above the lowermost ends of the guide rails 13 and 14 whereby the axle members 12 are in position to engage the upper surface of the guide rails 13 and 14 upon rolling the reel 10 from the dotted line position toward the solid line position shown in FIG. 1. The upwardly inclined guide rails 13 and 14 are supported by suitable frame sections 16 and 17, respectively, which are preferably detachably connected to each other by a transverse member 18 to retain the frame sections 16 and 17 at fixed positions relative to each other. Transverse member 18 may be in the form of an elongated rod-like member 18 which is detachably connected to suitable sleeve members 19 carried by each of the frame members 16 and 17, as shown. Accordingly, the distance between the frame sections 16 and 17 may be readily varied to accommodate reels of different widths by merely varying the length of the member 18. While I have shown the frame sections 16 and 17 as being detachably connected to each other by the transverse member 18, it will be apparent that a plurality of such members 18 may be employed. Also, the frame sections 16 and 17 may be secured rigidly to each other by permanent frame members where the apparatus does not have to be assembled and disassembled as it is transferred from place to place.

Figure 2:
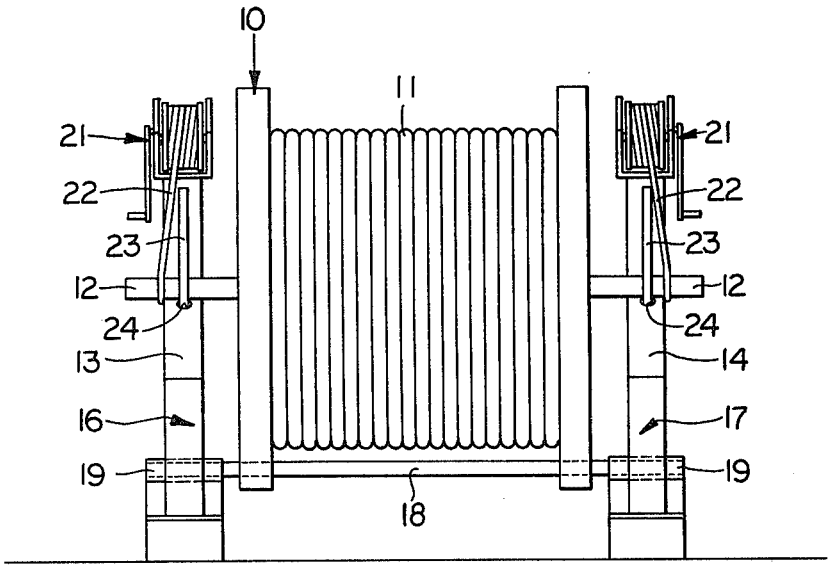
FIG. 2 is an end elevational view looking from the left side of FIG. 1.

In FIGS. 1–3 I show a power unit in the form of a winch 21 adjacent the uppermost end of each of the guide rails 13 and 14. Each winch 21 carries a flexible member, such as a rope cable 22 which is operatively connected to the axle member 12 adjacent thereto whereby each winch 21 is adapted to pull its cable 22 and the axle member 12 connected thereto toward the upper portion of its associated guide rail 13 or 14, as the case may be. Accordingly, as the axle members 12 move toward the upper portions of the guide rails 13 and 14, the axle members 12 are moved upwardly along and supported by the guide rails 13 and 14 as the reel 10 is lifted above the supporting surface S. In FIGS. 1 and 3, the end of the rope cable 22 extending from each winch 21 passes around the adjacent axle member 12 and then back toward the upper portion of the guide rail 13 or 14, as the case may be, with the free end of the rope cable 22 being anchored to a pin 25 located between the winch 21 and the uppermost position to be assumed by the adjacent axle member 12.

To hold the axle members 12 at selected positions along the guide rails 13 and 14, I provide upstanding, movable stop members in the form of pin-like members 23 which are adapted to telescope into the upper ends of tubular members 24 carried by each of the guide rails 13 and 14. Each movable stop member 23 is adapted to project above its guide rail in position to engage the adjacent axle member 12 and limit downward movement thereof along the guide rail to thereby retain the axle members 12 at selected positions along the guide rails, which positions are determined by the locations of the tubular members 24. The lower ends of the tubular members 24 are secured to the lower portion of the frame sections 16 and 17 by suitable means, such as by welding or the like.

From the foregoing description, the operation of my improved apparatus shown in FIGS. 1–3 will be readily understood. The reel 10 loaded with wire, cable, belt or the like is rolled to the dotted line position shown in FIG. 1. The flexible member 22 is passed around the axle members 12 and then toward the upper portion of the guide rails 13 and 14 with the end of the flexible member being anchored to the pin 25. Accordingly, upon turning the crank handle of the winch 21, the axle members 12 are moved toward the uppermost portion of the guide rails 13 and 14. Since the axle members 12 are at an elevation above the lowermost ends of the guide rails 13 and 14 while the reel 10 is supported by the supporting surface S, the axle members 12 will engage the guide rails 13 and 14 at positions adjacent the lower portions of the guide rails. When it is desired to support the reel 10 in the solid line position shown in FIG. 1, the reel 10 is moved to this position and the stop pin 23 is then inserted into the tubular member 24 adjacent thereto. The stop pin 23 thus limits downward movement of the axle members 12 relative to their guide rails 13 and 14 whereby the reel 10 is supported in the solid line position shown in FIG. 1 for free rotation whereby the material wound on the reel 10 may be dispensed by pulling the free end of such material to thus rotate the reel 10 in a manner well understood in the art to which my invention relates. When it is desired to support the reel 10 in the dot-dash line shown in FIG. 1, the handle of the winch 21 is ortated to thus pull the axle members 12 to a position along the guide rails 13 and 14 above the uppermost tubular member 24 whereby the stop pin 23 is then inserted into the uppermost tubular member 24 as shown in FIG. 1, whereby the reel 10 is then supported in the dot-dash line position. By providing means for supporting the reel at selected elevations along the guide rails 13 and 14, the apparatus is adapted to accommodate reels of different diameters.

Referring now to FIG. 4 of the drawings, I show the reel 10 as being supported by guide rails **13*a* and 14*a* which in turn are supported by supporting frame sections 16*a* and 17*a* respectively. Vertically extending tubular members 24*a* are carried by and extend through the guide rails 13*a* and 14*a* with the lower ends thereof being anchored to the frame members, as shown. A movable stop pin 23*a* is adapted to telescope into the upper end of the tubular members 24*a* to hold the reel 10 at selected elevations along the guide rails 13*a* and 14*a*. The frame sections 16*a* and 17*a* are detachably connected to each other by a transverse member 18*a* which telescopes into tubular members 19*a* to thus retain the frame sections 16*a* and 17*a* in spaced, parallel relation to each other. It will thus be seen that the frame sections 16*a* and 17*a* are substantially identical to the frame sections 16 and 17 shown in FIGS. 1–3, with the exception of the means for pulling the axle members 12 of the reel 10** upwardly along the guide rails, now to be described.

The axle members 12 are attached to the lower ends of flexible members in the form of chains 26. The other or uppermost end of each chain 26 is detachably connected to the free end of a link 27, such as by providing an upwardly opening slot at the free end of the link 27. The other end of each link 27 is connected rigidly to a shaft-like member 28 which extends through and rotates relative to the upper end of the adjacent guide rail **13*a* or 14*a*, as the case may be. The shaft-like members 28 extend inwardly of the guide rails 13*a* and 14*a* and the inner end of each shaft-like member 28 is secured to one end of a link 29. The other end of the link 29 is pivotally connected by a pin 31 to the upper end of a piston rod 32 of a fluid pressure operated cylinder 33. Accordingly, upon extending the piston rods 32 upwardly, the links 29 are rotated in a clockwise direction, as viewed in FIG. 4, to thus move the free upper ends of the links 27 in a clockwise direction whereby the chains 26 are pulled upwardly to move the axle members 12 upwardly along the guide rails 13*a* and 14*a*. After the reel 10 has been moved upwardly to the desired location along the guide rails, the pins 23*a* are inserted into the tubular member 24*a* whereby the axles 12 are held at a selected location along the guide rails whereby the wire, cable or the like wound on the reel 10 may be dispensed by pulling the free end of such wire or cable whereby the reel 10** is rotated while supported in the elevated position.

In FIG. 5, I show a slight modification of the apparatus shown in FIG. 4 wherein the upstanding links 27 are secured to shaft-like members **28*a* having splines 34 at the inner ends thereof which engage internal splines carried by sleeve members 36. The sleeve members 36 are secured to opposite ends of a shaft 37 whereby the shaft-like members 28*a* are connected to and adapted for rotation with the shafts 37. Upstanding links 38 are secured at their lower ends to the shaft 37 with the upper ends of the links 38 being pivotally connected by a pivot pin 39 to the upper end of a piston rod 41 of a fluid pressure operated cylinder 42. Upon extending the piston rod 41, the links 27 are moved to raised position to pull the flexible members 26 connected thereto upwardly relative to the guide rails 13*a* and 14*a*. On the other hand, upon contracting the cylinder 42 to retract the piston rod 41, the links 27 are pivoted in the opposite direction to permit the axle members 12 to move downwardly along the guide rails upon removal of the stop pins 23*a*. It will thus be seen that a separate drive unit may be mounted adjacent the upper end of each guide or a single drive unit may be operatively connected to both flexible members which pull the axle members 12** upwardly along the guide rails.

From the foregoing, it will be seen that I have devised improved apparatus for lifting a reel from a supporting surface. By providing at least one drive unit adjacent the upper ends of the guide rails for pulling the axle members of the reels upwardly along the guide rails, together with the stop members 23 which limit downward movement of the reel relative to the guide rails, I provide apparatus which may be operated by one mean to lift extremely heavy loads so that the wire, cable or the like may be readily removed by merely pulling on the free end of the wire or cable whereby the drum 10 is rotated. By providing sturdy means for supporting the guide rails and the improved means for moving the reel to selected positions along the guide rails, the apparatus is not only efficient in operation but provides maximum safety to the operator due to the fact that the reel is held against movement along the guide rails while the material, such as wire, cable, belting or the like is dispensed therefrom.

While I have shown my invention in several forms, it will be obvious to those skilled in the art that it is not so limited, but is susceptible of various other changes and modifications without departing from the spirit thereof.

What I claim is:

1. In apparatus for lifting a reel from a supporting surface with said reel having centrally disposed axle members projecting laterally from opposite sides thereof, (a) upwardly inclined guide rails supported in spaced parallel relation to each other with the upper surfaces of lower portions thereof in position to engage the under surface of said axle members while said reel is supported by said supporting surface, (b) a flexible member operatively connected to each said axle member and extending toward the upper portion of the guide rail adjacent thereto, (c) drive means operatively connected to the flexible members and adapted to pull said flexible members and the axle members connected thereto toward said upper portions of said guide rails so that said axle members are moved upwardly along and are supported by said guide rails as the reel is lifted above said supporting surface, and (d) movable stop members adapted to project above said guide rails in position to engage said axle members and limit downward movement thereof along said guide rails to thereby hold said axle members at at least one selected position along said guide rails.

2. Apparatus for lifting a reel as defined in claim 1 in which said movable stop members are pin-like members which telescope into upstanding tubular members carried by said guide rails.

3. In apparatus for lifting a reel from a supporting surface with said reel having centrally disposed axle members projecting laterally from opposite sides thereof, (a) upwardly inclined guide rails supported in spaced parallel relation to each other with the upper surfaces of lower portions thereof in position to engage the under surface of said axle members while said reel is supported by said supporting surface, (b) a flexible member operatively connected to each said axle member and extending toward the upper portion of the guide rail adjacent thereto, (c) a lever arm mounted for pivotal movement at one end adjacent the upper portion of each said guide rail with the other end thereof being connected to said flexible member, and (d) a fluid pressure operated power unit operatively connected to said lever arm and adapted to pull said flexible members and the axle members connected thereto toward said upper portions of said guide rails so that said axle members are moved upwardly along and are supported by said guide rails as the reel is lifted above said supporting surface.

4. Apparatus for lifting a reel as defined in claim 3 in which each lever arm is connected to the other lever arm by a shaft-like member which in turn is operatively connected to said fluid pressure operated power unit.

5. In apparatus for lifting a reel from a supporting surface with said reel having centrally disposed axle members projecting laterally from opposite sides thereof, (a) upwardly inclined guide rails supported in spaced parallel relation to each other with the upper surfaces of lower portions thereof in position to engage the under surface of said axle members while said reel is supported by said supporting surface, (b) a winch mounted adjacent an upper portion of each of said guide rails, and (c) a flexible member having an end thereof extending from each said winch and passing around the adjacent axle member and then toward the upper portion of said guide rail adjacent thereto with said end of said flexible member being anchored between said winch and the uppermost position to be assumed by said adjacent axle member to pull said flexible members and the axle members connected thereto toward the upper portions of said guide rails so that said axle members are moved upwardly along and are supported by said guide rails as the reel is lifted above said supporting surface.

* * * * *

UNITED STATES PATENT AND TRADEMARK OFFICE

CERTIFICATE OF CORRECTION

PATENT NO. : 4,204,663

DATED : May 27, 1980

INVENTOR(S) : William E. Baughn

It is certified that error appears in the above-identified patent and that said Letters Patent are hereby corrected as shown below:

On the title page, item [75] Inventor, should be deleted to read --- William E. Baughn, Bessemer Ala. ---.

Item [73] Assignee, should read --- Kenneth R. Williams and M. Kristian McAlister, part interest each ---.

Signed and Sealed this

*Twenty-ninth* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,204,663

DATED : May 27, 1980

INVENTOR(S) : William E. Baughn

It is certified that error appears in the above—identified patent and that said Letters Patent is hereby corrected as shown below:

On the title page, item [75] Inventor, should be deleted to read --- William E. Baughn, Bessemer, Alabama ---.

Item [73] Assignee, should read --- Milton J. Baughn, Kenneth R. Williams and M. Kristian McAlister, part interest each ---.

THIS CERTIFICATE SUPERSEDES CERTIFICATE OF CORRECTION ISSUED July 29, 1980.

Signed and Sealed this

*Twenty-first* Day of *October 1980*

[SEAL]

*Attest:*

SIDNEY A. DIAMOND

*Attesting Officer*

*Commissioner of Patents and Trademarks*